United States Patent [19]

Lakin et al.

[11] 4,270,982

[45] Jun. 2, 1981

[54] TURRET TYPE, SINGLE SPOT COKE OVEN DOOR MACHINE AND GUIDE

[75] Inventors: Ira Lakin, Volant; Gilbert Blair, Coraopolis, both of Pa.

[73] Assignee: Dravo Corporation, Pittsburgh, Pa.

[21] Appl. No.: 189,085

[22] Filed: Sep. 22, 1980

[51] Int. Cl.[3] ..... C10B 25/14; C10B 43/04; C10B 33/14

[52] U.S. Cl. ..... 202/241; 202/248; 202/262; 212/166

[58] Field of Search ..... 201/2; 202/241, 248, 202/262; 212/166; 414/744; 15/93 A

[56] References Cited

U.S. PATENT DOCUMENTS

| | | | |
|---|---|---|---|
| 3,436,316 | 4/1969 | Lorrek | 202/262 X |
| 3,577,321 | 5/1971 | Schaten | 202/248 X |
| 3,817,840 | 6/1974 | Stender | 202/241 |
| 4,003,802 | 1/1977 | Pries | 202/241 |
| 4,026,768 | 5/1977 | Bahnsch et al. | 202/248 X |
| 4,153,515 | 5/1979 | Gregor et al. | 202/241 |

FOREIGN PATENT DOCUMENTS

| | | | |
|---|---|---|---|
| 1559324 | 1/1980 | United Kingdom | 202/241 |

*Primary Examiner*—Frank W. Lutter
*Assistant Examiner*—Roger F. Phillips
*Attorney, Agent, or Firm*—Parmelee, Miller, Welsh & Kratz

[57] ABSTRACT

This invention provides an apparatus for the single spot servicing of a coke oven on the coke side of an oven battery. The apparatus includes a turret with oven servicing heads affixed thereto and mounted for rotational movement on the free end of a support arm which is mounted for pivotal movement about a fixed point on the car. Pantographic like linkage is provided to coordinate the rotational and pivotal movement of the turret assembly. A coke guide carriage is mounted for reciprocal movement along a rail system consisting of two rails in an angled relationship. The carriage and turret are mounted on the car to permit the sequential indexing of these servicing devices for use at a selected oven in the battery without repositioning of the servicing car relative to the battery.

21 Claims, 7 Drawing Figures

TURRET TYPE, SINGLE SPOT COKE OVEN DOOR MACHINE AND GUIDE

BACKGROUND OF THE INVENTION

1. Field of the Invention

This invention relates to a coke oven servicing car capable of one-spot servicing on the coke side of a coke oven battery.

2. Prior Art

A coke oven is a long, narrow chamber which is accessed on each end through a removable door. The ovens are generally arranged side by side in an integral structure which forms a coke oven battery. This battery is serviced on both sides by cars which travel along tracks parallel to the battery. On one side, referred to as the "pusher side," the car has pusher equipment which urges the coke from the oven. On the other side, the "coke side," the car has a coke guide which spans the coke side bench and guides the coke from the oven into a quenching car. Both cars are provided with door extractor and door jamb cleaning equipment. The door extractor unlocks, removes and then reinstalls the oven door. The door cleaner removes coke and breeze from the door gas channels. The door jamb cleaner removes coke and breeze from the oven door jamb just prior to the reinstallation of the oven door.

The servicing of a coke oven on either side of the battery is obviously a time consuming operation that heretofore has usually required that the servicing car be repositioned several times during the servicing of a single oven in order to present each piece of equipment to that oven. Each time the car is positioned or repositioned at a selected oven, the car is said to be spotted.

It has long been a goal within the industry to develop coke servicing cars capable of single spot servicing. The car, once initially spotted at a selected oven, would not be repositioned or moved until that oven had been completely serviced. The benefits in terms of time, energy and money saved are substantial. One attempt at single spot servicing is shown in U.S. Pat. No. 3,436,316 which describes a car equipped with a carriage mounted for lateral movement toward and away from a selected oven. Pivotally mounted on this carriage is a circular turntable which supports a coke guide which extends across the diameter of the turntable and a door extractor and door jamb cleaner positioned on either side of the coke guide. After the car is spotted at the coke oven, the turntable is rotated to present the appropriate servicing device and then the carriage slides toward the oven. The rotational and sliding motions of this device result in the movement of a tremendous amount of mass at each step of the servicing process. U.S. Pat. No. 4,026,768 discloses a "single spot" machine which has a variety of servicing devices mounted on a frame which longitudinally traverses the servicing car. The car itself may be spotted only once but the traversing frame requires several additional "spottings."

While the invention as disclosed provides a true one-spot servicing car for the coke side of an oven battery, a portion of the invention is readily adaptable for use on the pusher side of the oven as well. That portion of the invention is directed toward an apparatus which controls and positions the door extractor and door jamb cleaner. While attempts have been made to combine the door servicing heads with a single supporting apparatus, such as in U.S. Pat. No. 3,817,840, the resulting device did not lend itself to single spot servicing. U.S. Pat. No. 3,817,840 discloses a coke guide car on which a door extracting head and door jamb cleaning head are mounted at a 90° angle to each other on a vertical column. The column is mounted for rotational movement in order to present a selected servicing head to the oven and reciprocal movement perpendicular to the longitudinal axis of the servicing car. Such reciprocal movement allows the column to be extended and retracted toward and away from the oven face. However, longitudinal movement of the car or at least some part of the car is necessary before additional servicing devices can be presented to the oven.

Another limitation in the present state of the art is eliminated by the subject invention. Present coke guide cars typically carry the coke guide mounted perpendicularly to the longitudinal axis of the servicing car. As a result, the car is virtually cut in half because both operator vision and access from one side of the car to the other side of the car is substantially reduced or eliminated. To permit at least a "walk-through" capacity from one side of the car to the other when the coke guide carriage is in a stowed position, the coke guide carriage is provided with a pair of doors which allow workmen to gain access to the far side of the car by "walking through" the coke guide. Because the doors are an integral part of the coke guide cage itself, they are in direct contact with the high temperature coke. The heat from the coke is retained by the doors and the coke guide so the danger of burns and other injuries is ever present. The instant invention eliminates these and other hazards by parking the carriage in a stowed position which is on the side of the car away from the face of the oven and nearly parallel to the longitudinal axis of the car. Of course, the difficulties associated with a lack of "through-vision" on the car are also eliminated.

It is therefore an object of this invention to provide a coke side servicing car which offers increased visual control to the operator and enhanced safety to the maintenance workers aboard the car.

It is also an object of this invention to provide a servicing car with a unique configuration of oven servicing devices which permits sequential indexing of said devices on a one-spot servicing car.

SUMMARY OF THE INVENTION

This invention provides a coke oven servicing car capable of one-spot oven servicing. More particularly, a coke side servicing car is equipped with a coke guide carriage mounted on a rail system for movement toward and away from the selected oven and an oven door servicing device mounted on a turret for rotational and pivotal movement toward and away from the selected oven. The configuration of the turret and the carriage on the car permit the various servicing devices required for the coking operation to be sequentially indexed and aligned with a selected coke oven without repositioning or spotting the servicing car.

The turret has mounted thereon a door extractor head and a door jamb cleaning head and is part of a turret assembly which includes at least one support arm mounted at one end for pivotal movement about a primary vertical axis located in a fixed position on the servicing car. At the free end of the support arm the turret is mounted for rotational movement about a secondary vertical axis. A pantographic like linkage is provided to coordinate the rotational movement of the turret with the pivotal movement of the support arm so that as the arm swings toward the oven, the turret will follow as nearly a straight line as possible when the servicing head engages the oven being serviced. Means are also provided to rotate the turret independently of the pivotal movement of the arm so that either servicing device mounted on the turret may be presented to the oven for the purpose of servicing the same or positioning the door for door cleaning.

The coke guide carriage assembly includes a coke guide unit mounted on a rail system for movement toward and away from the oven. The coke guide unit includes a coke guide mounted within a carriage for reciprocal movement relative to the longitudinal axis of the carriage. The rail system is suspended from the overhead of the car and includes a first track section beginning at a point near the side of the car adjacent the coke oven battery and extending along a path having a major component transverse to the longitudinal axis of the car and a second track section lying along the side of the car remote from the oven face and having a substantial component parallel to the longitudinal axis of the car. The carriage is mounted on the rail system by a first and second trolley pivotally mounted on the carriage for travel on the first and second rails respectfully. The carriage reciprocates along the rail system from a stowed position parallel with the oven face along the remote side of the car to a servicing position aligned with the longitudinal axis of the oven being serviced.

The coke side servicing car of the present invention allows each piece of onboard equipment to be sequentially indexed toward and away from a selected coke oven. While the equipment is being indexed the operator is afforded an unobstructed view of the oven being serviced and vision "through the car." As a result, operational safety is increased, a safe walk area is provided for operating and maintenance personnel, and the operator's control over the equipment is enhanced.

DETAILED DESCRIPTION

Throughout the detailed description of the instant invention, the preferred embodiment will show the turret assembly and coke guide carriage assembly as an integrated system for the one-spot servicing of a selected oven on the coke side of the oven battery. It is to be understood that the turret assembly herein described is equally efficient when mounted on servicing cars for use on either the pusher or coke side of an oven battery. The coke guide carriage assembly should not be construed as only functional when used in combination with the turret assembly. While other relative configurations are possible, the arrangement of the turret assembly and carriage assembly as herein described provides the optimum in visibility and safety for the servicing car operator in addition to efficiency in coke side oven servicing.

Figure 1:
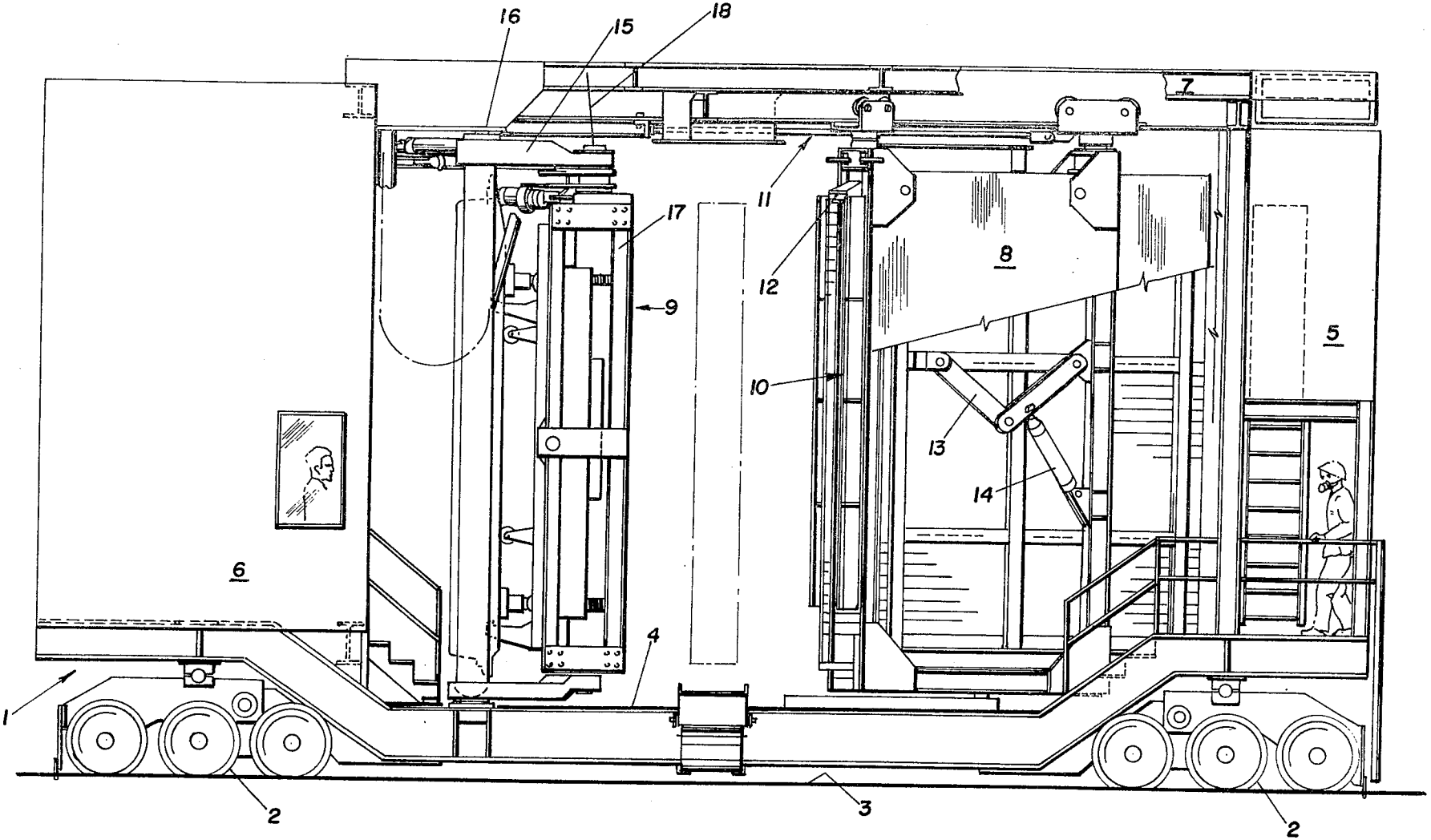
FIG. 1 is a side elevation view of a servicing car with some parts cut away, incorporating the features of the present invention.

Referring now to FIG. 1, a coke guide servicing car incorporating the features of this invention is generally referred to by the reference numeral 1. The car 1 is mounted on wheels 2 for movement parallel to one face of a coke oven battery along rails 3. The servicing car 1 includes a deck 4, an equipment house 5 located at one end and an operator control house 6 at the other end which provide vertical supporting bulkheads for the overhead 7. Also included on the servicing car 1 are the coke guide carriage assembly 8 and the turret assembly 9. It is, of course, possible to incorporate the assemblies of the instant invention onto a flat bed or open servicing car. However, the use of a servicing car as herein illustrated enhances the stability of the servicing equipment mounted thereon since the deck and overhead provide mounting surfaces for the equipment. The coke guide carriage assembly 8 includes an elongated open-ended box like carriage 10 mounted on an overhead rail system generally indicated by the numeral 11. A coke guide cage 12 is mounted within the carriage 10 for reciprocal movement along its longitudinal axis. Such reciprocal movement can be powered by an actuating arm 13 and hydraulic cylinder 14.

The turret assembly 9 includes an elongated support member 15 mounted for horizontal pivotal movement about a primary vertical axis 16 located on a fixed point on the car 1. At the free end of the support member 15 is a turret 17 which is mounted for rotational movement about a secondary vertical axis 18. Means are provided to coordinate the rotational movement of the turret 17 with the pivotal movement of the support arm 15. Preferably, this coordination is accomplished with an adjustable pantographic linkage which will be described infra. Means are also provided to rotate the turret independently of the support arm.

Figure 2:
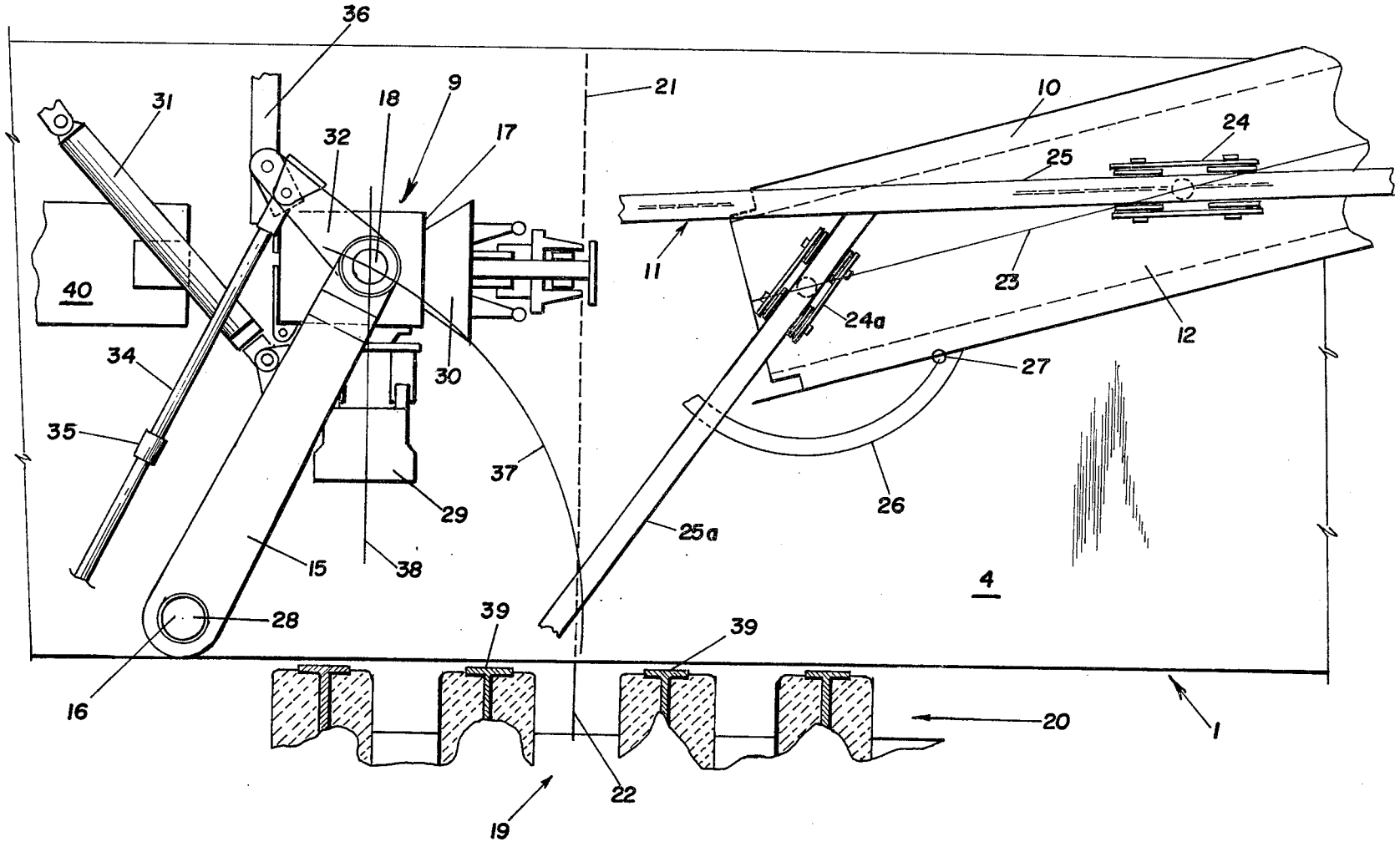
FIG. 2 is a plan view of a servicing car with some parts cut away.

Turning now to FIG. 2, the servicing car 1 is shown spotted at a selected oven 19 of a coke oven battery 20. The coke guide carriage 10 is shown withdrawn from the oven face in its stowed position. The turret assembly 9 is also in a stowed condition. The key to one-spot servicing lies in being able to align each oven servicing device with the oven without relocating the servicing car. Therefore, a single spot reference axis which extends across the car from front to back is indicated at 21. The servicing devices mounted on the car can be indexed so that the longitudinal axis of each device can be aligned with the single spot axis 21 without moving the car. In order to service the selected oven 19, the servicing car is spotted so that the axis 21 aligns with the longitudinal axis 22 of the oven 19.

The movement of the carriage 10 from the stowed position to the oven servicing position in which the longitudinal axis 23 of the coke guide cage 12 aligns with the single spot axis 21 is accomplished by a rear trolley 24 and a forward trolley **24*a* which travel along monorails 25 and 25*a* respectively. Power to drive the carriage 10 along the rail system 11 may be supplied by an electric motor, hydraulic cylinder or the like. The trolleys 24 and 24*a* are mounted for pivotal movement about a fixed point atop the carriage 10** adjacent to the ends thereof. Both monorails depend from the overhead 7 of the servicing car.

The rear rail 22 lies along the side of the car remote from the coke oven battery and has a substantial component parallel to the longitudinal axis of the car. The rail extends from a point slightly to the left of the single spot axis 21 to the equipment house 5 and, as illustrated, may be parallel to the longitudinal axis of the servicing car. The forward rail 25*a* begins at a point near the side of the car adjacent the coke oven battery, slightly to the left of the single spot axis 21 and extends along a path which has major component transverse to the longitudinal axis of the car. The forward rail 25*a* angles toward yet terminates short of the rear rail 25 in order to provide the clearance necessary for the rear trolley 24 to travel the rear rail 25.

Since both trolleys are mounted along the center line of the carriage 10 to insure proper balance and ease of movement, both rails must extend beyond the reference line 21 in order to allow the carriage to completely travel into alignment with the oven battery. When so aligned, the longitudinal axis of the coke guide cage 12 matches that of the selected oven 19. The carriage 10 does not mate with the oven but rather terminates its travel just short of the oven face. At this point, the coke guide 12 within the carriage is extended the final short distance to the oven.

The rail system 11 might also include a carriage stabilizing guide 26 in the form of an arcuate track section along the deck of the car and a guide pin 27 which depends from the bottom of the carriage 10 and engages the guide 26. The guide pin 27 rides within the stabilizing guide 26 and inhibits unnecessary and undesirable oscillation of the carriage 10 as it travels along the rail system.

Figure 3:
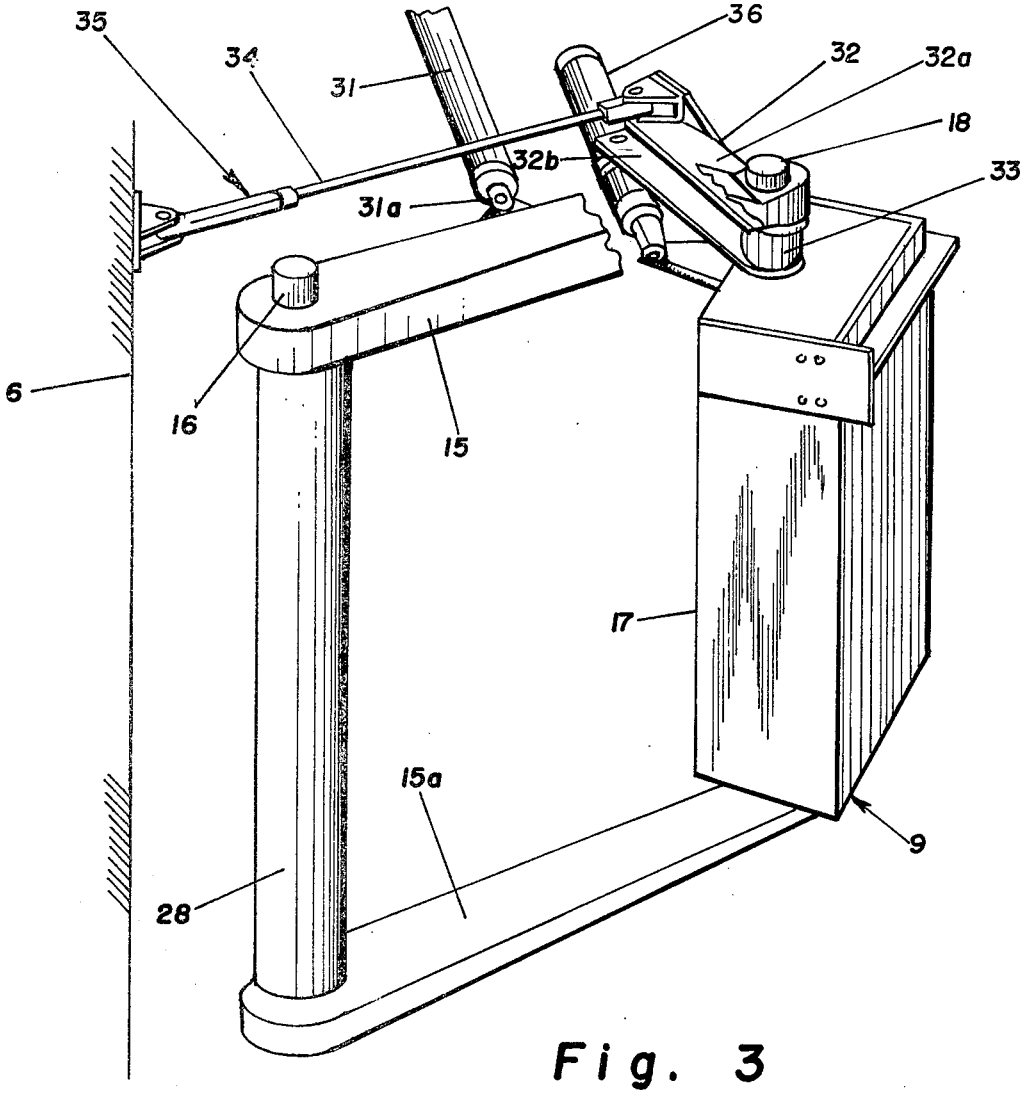
FIG. 3 is an isometric view of the turret assembly according to this invention with a portion cut away.

Turning now to both FIGS. 2 and 3, the turret assembly 9 as illustrated will be shown to travel in a clockwise direction when being pivoted from the stowed to the oven servicing position. If the relative position of the turret assembly and carriage assembly were reversed, the direction of travel for the turret would, of course, be 180° out of phase to the following description.

More particularly, the turret assembly 9 includes a mast 28 from which upper support arm 15 and lower support arm 15*a* extend to provide a frame for the turret 17. The mast 28 pivots about the primary vertical axis 16 and provides the pivotal movement which swings the assembly from the stowed position to the oven servicing position. Mounted on the turret 17 are two coke oven servicing devices, a door extractor head 29 and a jamb cleaner head 30 which is positioned to the right of the extractor head 29 as viewed in the Figures. Means such as a hydraulic cylinder 31 are provided to swing the frame and turret. In order to coordinate the pivotal movement of the support arms about the primary vertical axis 16 and the rotational movement of the turret 17 about the secondary vertical axis 18, a pantographic like linkage is provided. The linkage consists of the pantograph arm generally indicated by 32 which may be formed of a single member or an upper and lower arm 32*a* and 32*b* respectively with a collar 33 rigidly affixed therebetween. The pantographic arm 32 is mounted on the secondary vertical axis 18 between the support arm 15 and the turret 17 with the axis passing through the center of the collar 33. The upper pantograph arm 32*a* is pivotally connected to a pantographic link 34 which extends from the free end of the arm to a fixed point on the car about which it pivots. The pantographic link 34 has an adjusting device 35 which permits the length of the link 34 to be increased or shortened as necessary to control the exact geometry of the turret's rotation.

The lower arm 32*b* of the pantographic arm 32 is in communication with the turret 17 by means of a hydraulic cylinder 36 which is pivotally connected at both ends. The cylinder 36 serves a two fold purpose. It provides the link which connects the pantographic arm and the turret so that movement in the arm is translated into movement of the turret about the secondary axis and it provides the means by which the turrent is rotated independently of the pivotal movement of the support arm. The independent rotation of the turret permits the selection and presentation of either servicing device to the oven.

During the operation of the turret assembly, the secondary vertical axis 18 about which the turret 17 rotates, travels along an arc 37 which intersects the single spot axis 21 near the front of the car deck 4. The turret servicing head follows as nearly a straight line as is possible when the servicing head is about to mate with the selected oven. For example, when the turret 17 is presenting the door extractor head 29 to the oven, the head must pass between buckstays 39 which extend from the face of the oven. The clearance between these buckstays 39 and the extractor head is minimal and provides little room for nonlinear movement therebetween. Therefore, when in close proximity with the oven, the longitudinal axis 38 of the extractor head 29 will be nearly perfectly aligned with the axis 22 of the selected oven and servicing of the oven can be effected with no damage to the oven. The link adjusting device 35 permits the manipulation of the geometry of the turret rotation relative to the arc of travel in order to insure the head is in its optimum position relative to the axis of the selected oven as the servicing head passes between the buckstays and engages the selected oven.

An additional feature of the instant servicing car should also be discussed prior to the operational description of the car. A necessary piece of equipment in servicing a coke oven battery is a door cleaner which removes coke and breeze from the extracted door prior to the reinstallation of the door onto the oven. In FIG. 2, an oven door cleaner 40 is located on the deck 4 of the car 1 along the arc of travel 37 of the turret 17. With the door engaged by the extractor head, the turret is pivoted away from the oven and rotated in a clockwise direction by the hydraulic cylinder 36. This rotational movement, which is independent of the pivotal movement of the assembly, aligns the door and extractor head with the cleaner 40.

On occasion it becomes necessary to swing the turret beyond the side of the car into a servicing bay adjacent the face of the oven battery when, for example, the ceramic plugs on an oven door become damaged or worn and must be replaced. The hydraulic cylinder 31 is secured to the upper support arm 15 by a removable anchor pin 31*a*. Once the anchor pin 31*a* is removed, the entire frame on which the turret rotates may be swung beyond its normal range into the servicing bay. The frame can then be returned to a position on the car which permits the attachment of the cylinder 31 to the upper support arm 15 upon completion of the servicing operation.

OPERATION OF THE COKE SIDE SERVICING CAR

FIGS. 4 through 7 show the manner by which an oven is serviced by a car incorporating the features of this invention. Once the car 1 has been spotted at a selected oven 19, the servicing equipment mounted thereon is indexed from the stowed position, which is illustrated in FIG. 2, in the following sequence.

Figure 4:
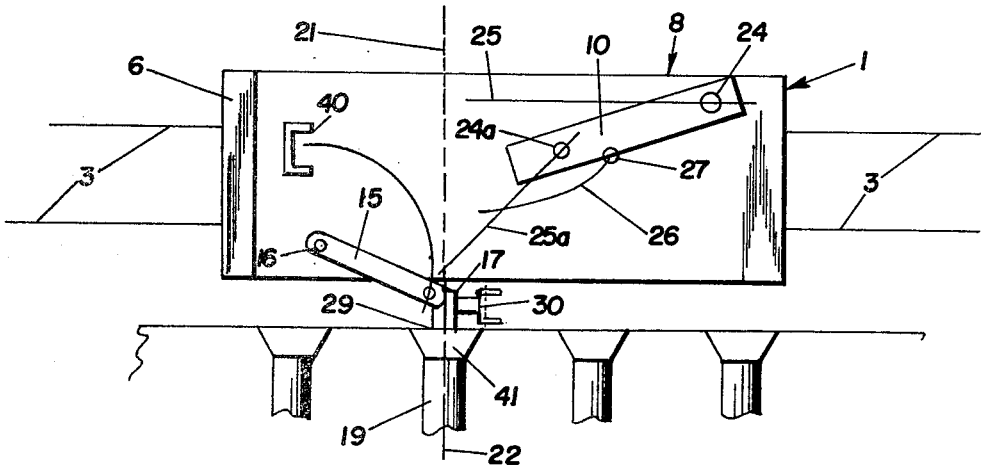
FIG. 4 is a schematic plan view of the apparatus of this invention with the turret aligned for door extraction.

In FIG. 4, the turret assembly support arm 15 has pivoted from the stowed position in a clockwise direction about the primary vertical axis 16 to the servicing position adjacent the coke oven. During the travel of the support arm 15, the pantographic linkage rotates the turret in a counterclockwise direction so that the extractor head 29 is following a nearly straight line of travel along the oven axis 22. The extractor head 29 engages the oven door 41 and unlocks and removes the same from the oven.

Figure 5:
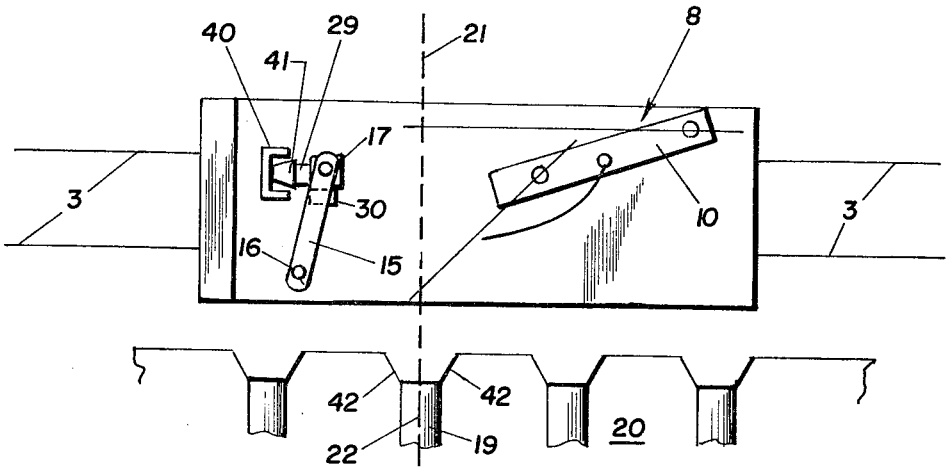
FIG. 5 is a schematic plan view of the apparatus of this invention with the turret presenting a door to a door cleaner apparatus.
Figure 6:
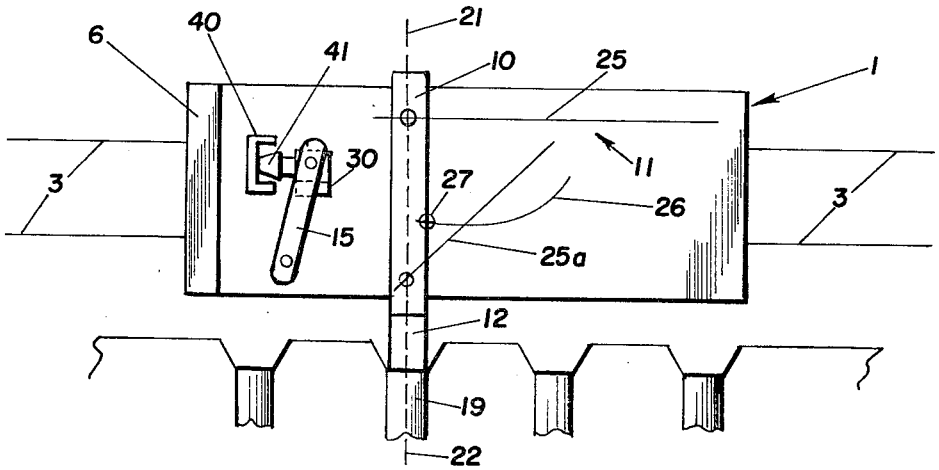
FIG. 6 is a schematic plan view of the apparatus of this invention with the coke carriage assembly in an oven servicing position.

As shown in FIG. 5, the turret 17 is removed from the oven to clear the spot axis 21 for the indexing of the carriage 10. After the support arm 15 is pivoted counterclockwise away from the oven 19, the turret is independently rotated about 90° in a clockwise direction in order to present the extracted door 41 to the door cleaner 40. This independent rotational movement also aligns the turret for the presentation of the door jamb cleaning head 30 to the open oven 19. As shown in FIG. 6, the carriage 10 is guided by the rail system 11 from a stowed position substantially parallel to the oven face into a servicing position along the single spot axis 21, substantially transverse to the longitudinal axis of the servicing car with one end of the carriage aligned with the oven. The coke guide cage 12 extends from the carriage and engages the oven. The coke is then pushed from the oven by a servicing device on the pusher side of the oven. After the coke is pushed into an adjacent quenching car (not illustrated), the guide 12 is disengaged from the oven and the carriage 10 is returned to the stowed position along the rail system 11.

Figure 7:
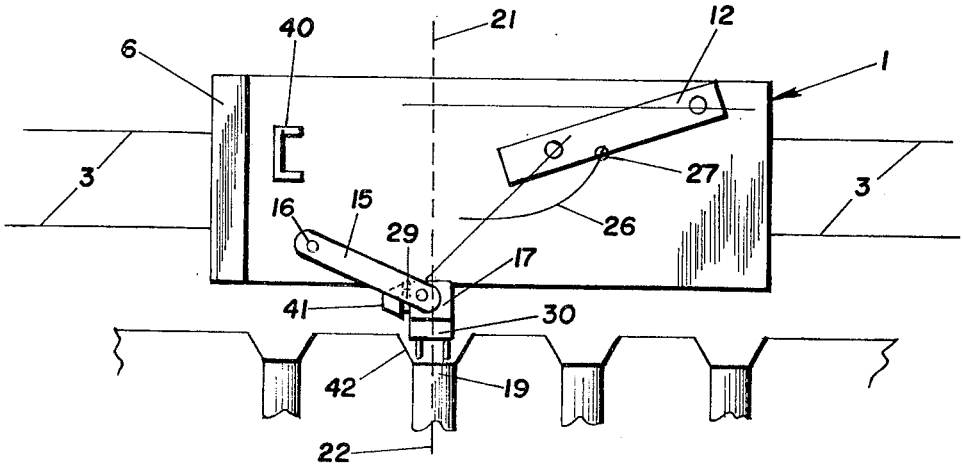
FIG. 7 is a schematic plan view of the apparatus of this invention with the turret presenting a door jamb cleaner to the oven door jamb.

Without any additional independent rotational movement of the turret 17, the arm 15 pivots clockwise toward the oven, thus disengaging the turret from the door cleaner 40. The pantographic linkage rotates the turret in conjunction with the pivotal movement of the arm so that the jamb cleaning head, which now faces the oven, will engage the oven while moving in as nearly a straight line as possible along the axis 21. As seen in FIG. 7, the turret is positioned adjacent the oven as the jamb cleaner head 30 removes coke and breeze from the oven door jamb 42. When the cleaning operation is complete, the support arm 15 need only be pivoted from the oven as far as is necessary to provide the clearance necessary to independently rotate the turret to present the extractor head 29 to the oven. The arm 15 then pivots back to the oven face, the door is reinstalled and the turret assembly returned to the stowed position. The coke side servicing of the oven is now complete and with all the servicing equipment returned to the stowed position, the car can be spotted at the next oven to be serviced.

The carriage assembly of the servicing car herein described, could easily be replaced with pusher and leveler equipment. Such replacement equipment, in coordination with the turret assembly of the present invention, would facilitate one-spot servicing on the pusher side of a coke oven battery.

A coke side servicing car equipped with a turret assembly and a coke guide carriage assembly capable of one-spot servicing has been disclosed. The servicing equipment on board the car can be sequentially indexed so that an oven is completely serviced without repositioning the car relative to the oven.

What is claimed is:

1. An apparatus for servicing a coke oven battery comprising:

(a) a car mounted on wheels for movement along its longitudinal axis in a direction substantially parallel to the face of a coke oven battery;

(b) at least one support member mounted at one end about a primary vertical axis located in a fixed position on the car for pivotal movement in a horizontal plane about said primary axis;

(c) a turret having affixed thereto at least one coke oven servicing device mounted at the free end of said at least one support member for rotational movement in a horizontal plane about a secondary vertical axis such that pivotal movement of said at least one support member about the primary axis extends and retracts the turret toward and away from a selected coke oven in the battery along an arc defined by the pivotal movement of said at least one support member;

(d) means to pivot said at least one arm about the primary vertical axis; and (e) means for rotating said turret about the secondary vertical axis in coordination with the pivotal movement of said at least one support member about the primary axis, said means including therein a means for rotating said turret about the secondary vertical axis independently of the pivotal movement to provide a first selected rotational position relative to the selected coke oven in which the servicing device is presented to the coke oven, said first selected position being maintained during at least part of the travel of the turret along the arc by said coordinating means for rotating said turret wherein for a first pivotal position of the support member the turret is adjacent the oven face for servicing the same and for a second pivotal position the turret is distal from the selected oven.

2. The apparatus of claim 1 wherein two support members are mounted in a vertically spaced relation for pivotal movement about the primary vertical axis and the turret is mounted for rotational movement between the free ends of said support members.

3. The apparatus of claim 1 wherein the turret has two coke oven servicing devices, one of which is a door extractor so that for a first rotational position of the turret about the secondary vertical axis, the door extractor is aligned with the selected coke oven, and the second of which is a door jamb cleaning head so that for a second rotational position of the turret, the jamb cleaner is aligned with the selected coke oven.

4. The apparatus of claim 3 including a door cleaner mounted on the car where, at a further part of the travel of the turret along the arc defined by the pivotal movement of the support arm about the primary axis, the turret can be rotated to align the door extractor head with said door cleaner.

5. The apparatus of claim 3 wherein the means for rotating the turret about the secondary axis in coordination with the pivotal movement of the support arm about the primary axis includes a pantographic arm pivotally mounted at one end for movement about the secondary axis, and a pantographic link pivotally mounted at one end for movement about a fixed point on the car, said link being generally horizontal and parallel with the support member, and pivotally connected at its free end to the free end of said pantographic arm, said free end of the pantographic arm being in communication with the turret the means for the independent rotation of the turret about the secondary axis.

6. The apparatus of claim 5 wherein the pantographic link has means for adjusting its length, said adjusting means allowing the turret to follow a nearly straight path when in close proximity to the selected coke oven.

7. The apparatus of claim 1 or 5 wherein the means for independently rotating the turret about the secondary vertical axis is a hydraulic cylinder.

8. The apparatus of claim 1 in combination with an additional servicing unit mounted on the servicing car for movement between a stowed and a servicing position, said stowed position being such that said support arm can assume its first pivotal position adjacent to said selected coke oven in said battery and said servicing position being such that when said support arm is in its second pivotal position distal from the oven face, said additional unit can assume operative alignment with said selected coke oven.

9. The apparatus of claim 8 wherein said additional servicing unit is a coke guide unit assembly comprising a track system mounted on said car and a coke guide unit mounted on said track system for reciprocal movement from a servicing position proximate the face of the oven and a stowed position distal the face of the oven.

10. The apparatus of claim 9 wherein the track system includes at least two tracks comprising a first and second track section, said first section beginning at a point near the side of the car adjacent the coke oven battery and extending along a path having a major component transverse to the longitudinal axis of the car and said second track lying along the side of the car remote from the coke oven battery and having a substantial component parallel to the longitudinal axis of the car, and the coke guide carriage has first and second trolleys pivotally mounted to the coke guide unit adjacent the ends thereof with said first and second trolleys mounted for reciprocal movement along said first and second track sections respectively such that said coke guide unit can be reciprocated from a servicing position wherein the longitudinal axis of said coke guide unit is substantially transverse to the longitudinal axis of the servicing car and a stowed position wherein the coke guide unit is remotely spaced from said selected coke oven.

11. The apparatus of claim 10 wherein said track sections are straight lengths of track and said second track extends substantially parallel to the longitudinal axis of said servicing car along the side of the car remote from the coke oven battery whereby in said stowed position the coke guide unit is adjacent said remote side of the servicing car.

12. The apparatus of claim 11 wherein the coke guide unit includes a carriage on which said trolleys are pivotally mounted and a coke guide which is mounted on said carriage for reciprocal movement along its longitudinal axis such that when said carriage is indexed into a servicing position, said coke guide can be extended and retracted toward and away from the selected oven.

13. The apparatus of claim 10 or 12 wherein the car includes an overhead portion from which said tracks of the rail system depend with said coke guide unit suspended from said overhead tracks.

14. The apparatus of claim 12 wherein the rail system includes a third track on the car and a guide mounted on the lower portion of the coke guide unit which rides on said third track to provide stability to said unit as it travels along its depending tracks.

15. The apparatus of claim 1 wherein the means to pivot said at least one arm about the primary vertical axis is a hydraulic cylinder detachably connected to said arm to allow said arm to pivot beyond its usual arc of travel defined by the pivotal movement of said arm as effected by said hydraulic cylinder.

16. An apparatus for servicing a selected coke oven in a coke oven battery comprising:

(a) a servicing car having a deck and an overhead portion mounted on wheels for movement along its longitudinal axis in a direction substantially parallel to one face of the oven battery;

(b) a track system having first and second track sections, said first section beginning at a point near the side of the car adjacent the coke oven battery and extending along a path having a major component transverse to the longitudinal axis of the car, said second track section lying along the side of the car remote from the coke oven battery and having a substantial component parallel to the longitudinal axis of the car;

(c) an elongated coke guide unit and first and second trolleys pivotally mounted to the coke guide unit adjacent the ends thereof with said first and second trolleys mounted for reciprocal movement along said first and second track sections respectively such that said coke guide unit can be reciprocated from a servicing position wherein the longitudinal axis of said coke guide unit is substantially transverse to the longitudinal axis of the servicing car with one end of the coke guide unit aligned with a selected oven in the coke oven battery and a stowed position wherein the coke guide unit is remotely spaced from said selected oven.

17. The apparatus of claim 16 wherein said track sections are straight lengths of track and said second track extends substantially parallel to the longitudinal axis of said servicing car along the side of the car remote from the coke oven battery whereby in said stowed position the coke guide unit is adjacent said remote side of the servicing car.

18. The apparatus of claim 17 wherein the coke guide unit includes a carriage on which said trolleys are pivotally mounted and a coke guide cage which is mounted on said carriage for reciprocal movement along its longitudinal axis such that when said carriage is indexed into a servicing position, said coke guide cage can be extended and retracted toward and away from the selected oven.

19. The apparatus of claim 16 or 18 wherein the car includes an overhead portion from which said tracks of the rail system depend with said coke guide unit suspended from said overhead tracks.

20. The apparatus of claim 18 wherein the rail system includes a third track on the car and a guide mounted on the lower portion of the coke guide unit which rides on said third track to provide stability to said unit as it travels along its depending tracks.

21. The apparatus of claim 16 in combination with an additional servicing unit mounted on said servicing car for movement between first and second positions, said first position being such that said coke guide unit can assume its servicing position aligned with said selected coke oven in said battery and said second position being such that with said coke guide unit in its stowed position said additional servicing unit can assume operative alignment with said selected coke oven.

* * * * *